US006867355B2

(12) United States Patent
Okamoto

(10) Patent No.: US 6,867,355 B2
(45) Date of Patent: Mar. 15, 2005

(54) DRUM ACOUSTIC WIRE ASSEMBLY AND A DRUM USING THE SAME

(75) Inventor: Tomio Okamoto, Hamamatsu (JP)

(73) Assignee: Yamaha Corporation, Shizuoka (JP)

( * ) Notice: Subject to any disclaimer, the term of this patent is extended or adjusted under 35 U.S.C. 154(b) by 0 days.

(21) Appl. No.: 10/387,904

(22) Filed: Mar. 13, 2003

(65) Prior Publication Data

US 2003/0172794 A1 Sep. 18, 2003

(30) Foreign Application Priority Data

Mar. 13, 2002 (JP) ..... 2002-068251

(51) Int. Cl.[7] ..... G10D 13/02
(52) U.S. Cl. ..... 84/415
(58) Field of Search ..... 84/415, 417, 411.2, 84/413

(56) References Cited

U.S. PATENT DOCUMENTS 3,757,027 A * 9/1973 Morena et al. ..... 84/416
5,507,214 A * 4/1996 Hoshino ..... 84/415

FOREIGN PATENT DOCUMENTS

JP 58-50372 11/1983

* cited by examiner

*Primary Examiner*—Kimberly Lockett
(74) *Attorney, Agent, or Firm*—Koda & Androlia

(57) ABSTRACT

A drum acoustic wire assembly installed on a drumhead, including a plurality of acoustic wires disposed side by side in a direction perpendicular to the direction of the axis of each one of the wires, and a pair of wire holding plates that hold both ends of the acoustic wires. The acoustic wires are coil-form wires and are connected by soldering to the undersurfaces of the tip (inner) end portions of the wire holding plates. Projecting portions are formed on the undersurfaces of the base ends of the wire holding plates, so that, when the acoustic wires are in contact with the drumhead, the tip (inner) ends and the base (outer) ends of the wire holding plates are at substantially the same height or the tip ends are lower than the base ends.

4 Claims, 3 Drawing Sheets

DRUM ACOUSTIC WIRE ASSEMBLY AND A DRUM USING THE SAME

BACKGROUND OF THE INVENTION

1. Field of the Invention

The present invention relates to a drum acoustic wire and more particularly to a drum acoustic wire assembly which is used in a drum such as a snare drum, marching drum, bass drum, tom-tom, etc. and also relates to a drum that uses such a drum acoustic wire assembly.

2. Prior Art

A snare drum, for instance, is designed so that a special acoustic that imparts the musical instrument a peculiar light tone color known as "pattering" by way of selectively causing a drum acoustic wire to come into contact with and then separate from the drumhead and thus transmitting the vibration of the drumhead to the drum acoustic wire. Japanese Utility Model Application Publication No. 58-50372, for instance, discloses a structure for mounting such a drum acoustic wire.

FIG. 4, a top view, and FIG. 5, a sectional view, shows the structure of this prior art. The reference numeral 1 in FIGS. 4 and 5, is a drum main body, 2 is an bottom-side drumhead stretched over the lower opening of the drum main body 1, 3 is a drum acoustic wire assembly which includes acoustic wires and is mounted on the surface of the drumhead 2. The reference numeral 4 is a head frame, 5 is a tightening frame, and 6 is a strainer that causes the wires of the drum acoustic wire assembly 3 to come into contact with and to be separated from the drumhead 2.

The drum acoustic wire assembly 3 comprises a plurality of slender coil-form wires 11 that are disposed side by side in a direction that is perpendicular to the direction of the axes or axial lines of the wires, and a pair of band-equipped wire holding plates 12 (only one plate 12 is shown) that hold both end portions of these acoustic wires 11. The band 13 of each wire holding plate 12 is connected to the strainer 6. The end portions of the acoustic wires 11 are joined by soldering to the tip end portions of the undersurfaces of the wire holding plates 12 so that these soldered portions constitute the fastening sections of the acoustic wires 11. The above-described bands 13 (only one band 13 is shown) are connected at the tip ends to the base ends of the wire holding plates 12.

When the drum is played with the drum acoustic wire assembly 3 set thereon, the acoustic wires 11 are brought into contact with the surface of the drumhead 2 when the rollers 15 of the strainer 6 are pulled downward below the surface level of the drumhead 2, thus applying tension to the acoustic wires 11.

Since the quantity of the percussive sound of the drumhead 2 and acoustic wires 11 is proportional to the amount of contact between the drumhead 2 and the acoustic wires 11, so as to increase the quantity of the percussive sound, it is necessary to increase this amount of contact by way of causing the acoustic wires 11 to contact the drumhead 2 throughout substantially its entire region in the direction of length. Furthermore, it is desirable that substantially uniform contact be made throughout the entire region in the direction of length of the wires 11.

In the above conventional drum acoustic wire assembly 3, as seen from FIG. 5, the end portions of the acoustic wires 11 (only one wire 11 is shown) are connected at fastening sections 14 (only one fastening section 14 is shown) by soldering to the tip ends of the wire holding plates 12 (only one wire holding plate 12 is shown). As a result, the thickness of the tip ends 12*a* of the wire holding plates 12 is greater than the thickness of the base ends 12*b* of the wire holding plates 12. Accordingly, when the acoustic wires 11 are caused to contact the surface of the drumhead 2 by pulling the bands 13 downward by means of the strainer 6 and by applying tension to the acoustic wires 11, the base ends 12*b* of the wire holding plates 12 sink downward, causing the undersurfaces of the tip end portions of the bands 13 and the undersurfaces of the base ends 14*a* of the fastening sections 14 to contact the drumhead 2. When this occurs, the tip ends 14*b* of the fastening sections 14 are caused to float upward from the surface of the drumhead 2; and as a result, the end portions 11*a* of the acoustic wires 11 that are near the fastening sections 14 float upward from the surface of the drumhead 2. Thus, a good and tight contact of the acoustic wires 11 for its entirety with the drumhead 2 is not obtained, and it is impossible to increase the amount of contact of the acoustic wires 11 with the drumhead 2.

SUMMARY OF THE INVENTION

Accordingly, it is an object of the present invention to solve the above-described problems in the prior art drum acoustic wires.

It is another object of the present invention to provide a drum acoustic wire assembly and a drum in which the acoustic wires are caused to make a good and tight contact with the surface of a drumhead throughout the entire region in the direction of length of the acoustic wires.

The above objects are accomplished by a unique structure for a drum acoustic wire assembly to be installed on a drumhead of a drum, and the drum acoustic wire assembly comprises:

- a plurality of acoustic wires disposed side by side in the direction that is perpendicular to axial direction of the wires, and
- a pair of wire holding plates that hold end portions of the acoustic wires, so that the acoustic wires are brought into contact with and separated from the drumhead; and in the present invention,
- each of the wire holding plates is formed so that its tip end is at substantially the same height as or is lower than its base end when the acoustic wires are in contact with the drumhead.

With the above structure, since the sinking of the base ends of the wire holding plates can be prevented, the end portions of the acoustic wires are kept in tight contact with the drumhead.

For the structure that the tip end of each wire holding plate is at substantially the same height as or lower than its base end, the base end is provided on its undersurface with a projecting portion so that the base end is larger in thickness than the tip end, thus being higher than the front end.

By way of allowing the projecting portions to be in contact with the drumhead, the sinking of the base ends of the wire holding plates is prevented.

The drum acoustic wire assembly that has the above-described unique structure can be mounted on any type of drum, and a drum in which the acoustic wires are in good and tight contact with its drumhead is obtained.

DETAILED DESCRIPTION OF THE INVENTION

The present invention will be described in detail below with reference to the accompanying drawings.

Figure 1:
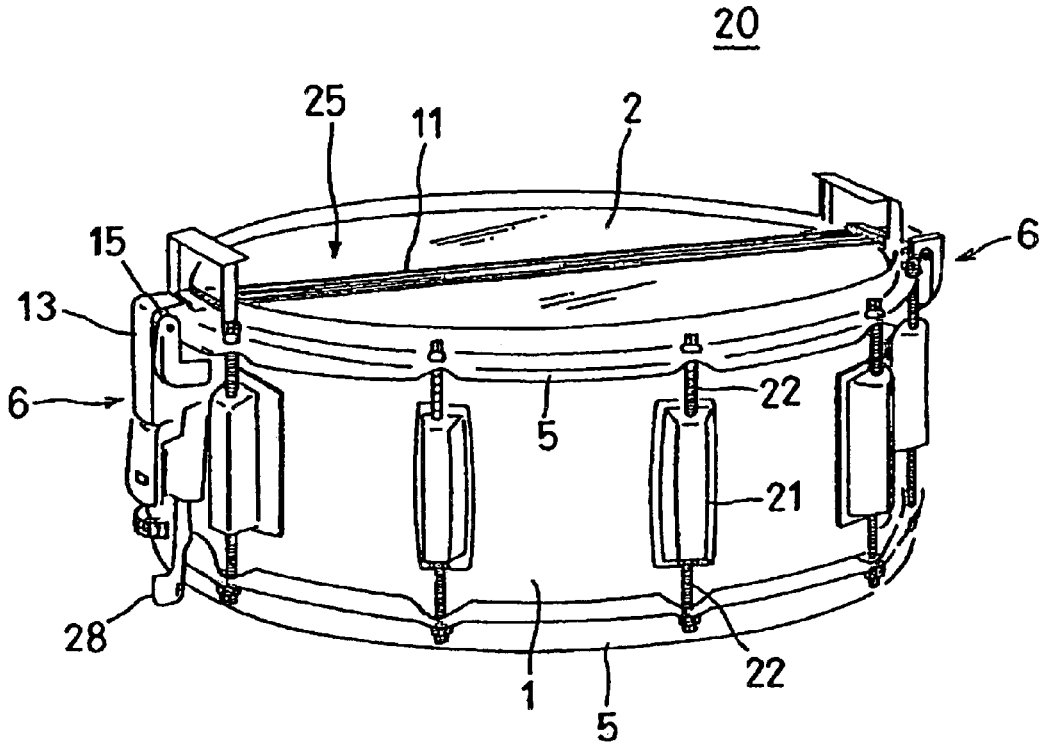
FIG. 1 is an external perspective view of a snare drum equipped with the drum acoustic wire assembly according to the present invention.
Figure 2:
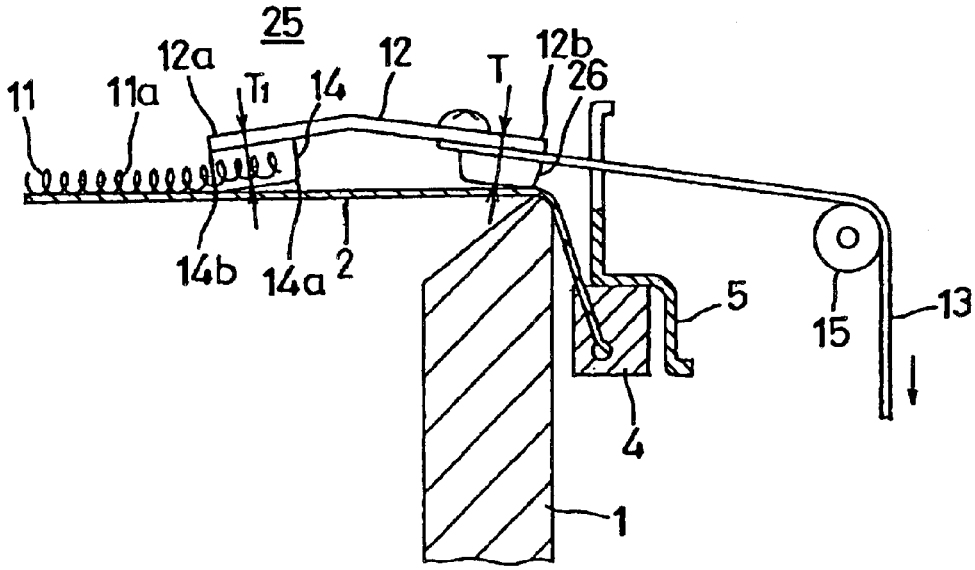
FIG. 2 shows in cross-section the essential portion of the drum acoustic wire assembly in use in which coil-form acoustic wires are employed.
Figure 4:
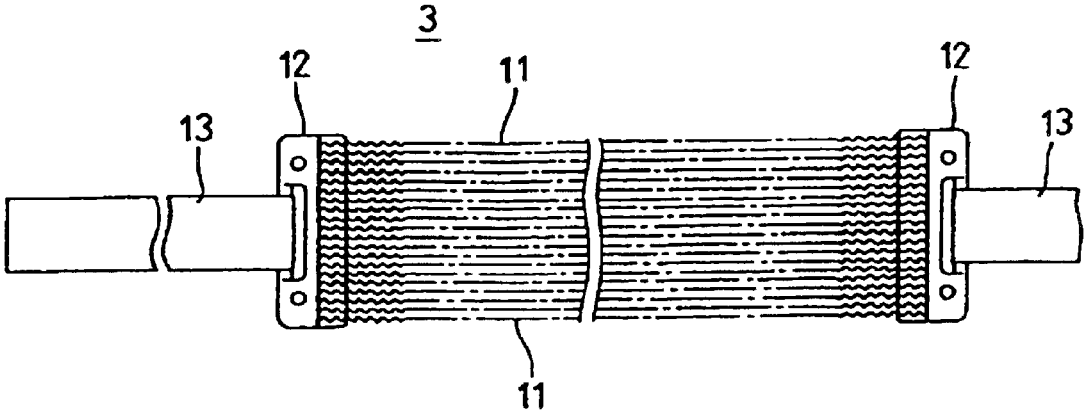
FIG. 4 PRIOR ART
FIG. 4 is a top view of a conventional drum acoustic wire assembly.
Figure 5:
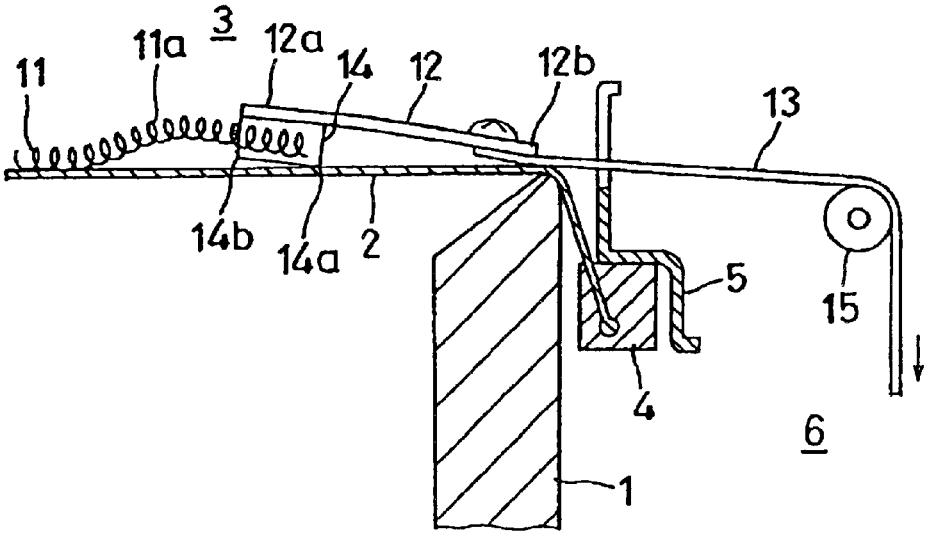
FIG. 5 PRIOR ART
FIG. 5 shows in cross-section the essential portion of the drum acoustic wire assembly of FIG. 4 in use.

FIG. 1 shows a snare drum equipped with the drum acoustic wire assembly of the present invention, and FIG. 2 shows in cross section the essential portion of the wire assembly that is in use and includes coil-form acoustic wires. The constituting elements that are the same as those in the prior art shown in FIGS. 4 and 5 are labeled with the same reference numerals, and a description thereof is omitted below. In the shown embodiment, the present invention is applied to a snare drum, and the drum acoustic wire assembly is mounted on the surface of the bottom-side drumhead.

The snare drum 20 comprises a cylindrical drum main body 1 which is open at both ends. The top-side (percussion side) drumhead (not shown) and the bottom-side (non-percussion side) drumhead 2 are respectively stretched over the openings at both ends of the drum main body 1. These drumheads are formed from natural leather consisting of the hide of an animal or from a synthetic resin film such as a polyester, polycarbonate, etc. The outer circumferential edge portions of the drumheads are respectively held by annular head frames 4. The head frames 4 are mounted on the outer circumferences of the openings of the drum main body 1, and they are respectively covered by annular tightening frames 5.

The tightening frames 5 are respectively connected to a plurality of lugs 21 attached to the outer surface of the drum main body 1 via tightening bolts 22. The tension of the respective drumheads is adjusted by rotating the tightening bolts 22 so that the two tightening frames 5 are caused to approach or move away from each other. In other words, when the tightening bolts 22 are tightened so that the tightening frames 5 are moved toward the middle portion (in the axial direction) of the drum main body 1, the tightening frames 5 press against the head frames 4 of the respective drumheads and cause these head frames 4 to move toward the middle portion of the drum main body 1. As a result, the tension of the respective drumheads is increased. Conversely, when the tightening bolts 22 are loosened, the pressing force of the tightening frames 5 on the head frames 4 decreases, and the tension of the drumheads decreases.

A drum acoustic wire assembly 25 is mounted on the surface of the bottom-side drumhead 2. The drum acoustic wire assembly 25 is comprised of a plurality of (10 to 30) slender acoustic wires 11 and two band-equipped wire holding plates 12 (only one wire holding plates 12 is shown in FIG. 2) that respectively hold both ends of each one of the acoustic wires 11. The acoustic wires 11 are lined up at a fixed spacing (e.g., 2.9 mm) on the same plane in the direction perpendicular to the axial line of each wire.

Slender coil-form steel wires are used as the acoustic wires 11 in the drum acoustic wire assembly 25. Both ends of each one of the acoustic wires 11 are joined or connected by soldering to the undersurfaces (in FIG. 2) of the tip ends (inner sides with respect to the main drum body 1) 12*a* of the wire holding plates 12. The soldered portions form fastening sections 14. The fastening sections 14 (only one fastening section 14 is shown in FIGS. 1 and 2) have a substantially rectangular cross-sectional shape, and it extends across substantially the entire width (which corresponds to the tangential direction of the drum main body 1) of the wire holding plates 12. A band 13 is attached to the base end 12*b* of each wire holding plate 12.

The wire holding plates 12 are made of metal; and they are constructed so that when the acoustic wire assembly 25 is in use and the acoustic wires 11 are in contact with the drumhead 2, the height $T_1$ of the tip end 12*a* and the height T of the base end 12*b* of each wire holding plate 12 are substantially equal. It can be designed also so that the height $T_1$ of the tip end 12*a* of the wire holding plate 12 is lower than the height T of the base end 12*b* of the wire holding plate 12.

So as to provide the above described structure of the wire holding plates 12, in the shown embodiment, each one of the wire holding plates 12 is bent into a peak shape so that the upper surface side (in FIG. 2) of the wire holding plate 12 protrude as best seen from FIG. 2, and a projecting portion 26 is provided on the under surface of the base end 12*b* of the wire holding plate 12 so that it projects from the undersurface (in FIG. 2) of the base end of the wire holding plate 12. The thickness of the projecting portion 26 is set to be substantially equal to or greater than the thickness of the fastening section 14.

Figure 3:
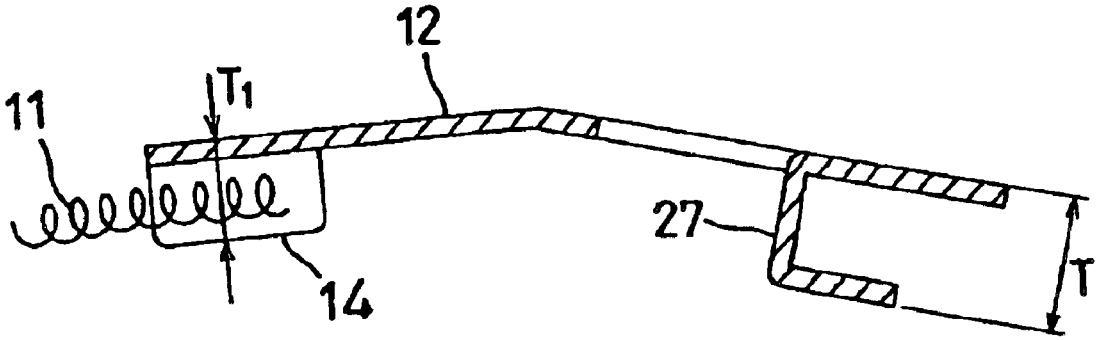
FIG. 3 shows in cross-section the side of a wire holding plate used in the drum acoustic wire assembly according to the present invention, the wire holding plate being different from that shown in FIG. 2.

The projecting portion 26 can be formed so as to protrude from the undersurface of (the base end of) the wire holding plate 12 by indenting the upper surface side of the wire holding plate 12. Alternatively, part of the wire holding plate 12 can be beat out on the undersurface so that (the base end of) the wire holding plate 12 is bent into an L-shape as shown in FIG. 3 so that the bent portion 27 is used as the projecting portion. Instead, plastic projecting portions can be formed integrally to the holding plate 12 by insert molding, etc.

In FIG. 2, the height $T_1$ of the tip end 12*a* side of the wire holding plate 12 includes the thickness of the wire holding plate 12 and the height of the fastening section 14; and the height T of the base end 12*b* side of the wire holding plate 12 includes the thickness of the wire holding plate 12, the thickness of the bands 13 and the height of the projecting portions 26.

In FIG. 3, the height $T_1$ of the tip end 12*a* of the wire holding plate 12 is a dimension that includes the thickness of the wire holding plate 12 and the height of the fastening section 14, and the height T of the base end 12*b* of the wire holding plate 12 is a dimension that extends from the undersurface of the bent portion 27 to the upper surface of the wire holding plate 12.

In the embodiment shown in FIGS. 2 and 3, the height $T_1$ of the tip end 12*a* is set lower than the height T of the base end 12*b*.

In use, the drum acoustic wire assembly 25 having the structure described above is mounted on the bottom-side drumhead 2 in the same manner as a conventional drum acoustic wire assembly. In other words, the bands 13 attached to the wire holding plates 12 of the drum acoustic wire assembly 25 are connected to the strainer 6 which are diametrically opposite from each other on the outer circumference of the drum main body 1.

When not in use, the drum acoustic wire assembly 25 is held in a non-contact state in which the wires 11 of the drum acoustic wire 25 are not in contact with the drumhead 2.

At the time of use, the acoustic wires 11 of the drum acoustic wire assembly 25 are set to contact with the surface of the drumhead 2 by being pulled down toward the drumhead 2 by the operation of a lever 28. In other words, the lever 28 which is a part of the strainer 6 is operated so as to pull down the rollers 15 to below the surface level of the drumhead 2, thus applying tension to the acoustic wires 11 and bringing the wires 11 to come into contact with the drum head 2. Accordingly, when the top-side drumhead (not shown) of the drum is struck with the wires 11 being in contact with the bottom-side drumhead 2, the vibration of the top-side drumhead is transmitted to the acoustic wires 11 via the bottom-side drumhead 2, and the special acoustic effect of a light tone color known as "pattering", which is peculiar to the instrument, is produced.

In the present invention, the projecting portions 26 that protrude from the undersurfaces of the base end portions of the wire holding plates 12 are caused to contact the surface of the drumhead 2 when the acoustic wire assembly 25 is pulled downward (in FIG. 2). Consequently, the base ends 12*b* of the wire holding plates 12 do not sink inward, and the tip ends 14*b* of the undersurfaces of the fastening sections 14 at the tip ends 12*a* of the wire holding plates 12 are caused to contact the surface of the drumhead 2 as shown in FIG. 2. Accordingly, the end portions 11*a* of the acoustic wires 11 of the acoustic wire assembly 25 that are near the wire holding plates 12 do not float upward from the surface of the drumhead 2, and a good and tight contact with the drumhead 2 is obtained throughout substantially the entire region in the direction of length of the acoustic wires 11. Thus, the amount of contact of the wires 11 with the drumhead 2 is large; and with this large amount of contact areas of the wires 11, the quantity of the percussive sound of the drumhead 2 and acoustic wires 11 considerably increases compared to that obtained in the conventional drum acoustic wire assembly 3 shown in FIG. 5.

In the shown embodiment, the projecting portions 26 are provided on the undersurfaces (that face the drumhead 2) of the wire holding plates 12. Accordingly, when the acoustic wire assembly 25 is moved toward the drumhead 2 by the strainer 6, thus causing the bands 13 of the acoustic wire assembly 25 to pull the acoustic wires 11 so that the acoustic wires 11 come into contact with the drumhead 2, then the tip ends 14*b* of the fastening sections 14 are pushed against the drumhead 2 with the projecting portion 26 being used as a fulcrum. As a result, the acoustic wires 11 contact the drumhead 2 for their entirety from one end to the other, and the wires 11 are kept in contact with the drumhead 2 by a strong pushing force.

Furthermore, the bands 13 are connected to the wire holding plates 12 by way of being disposed between the wire holding plates 12 and the projecting portions 26. Accordingly, the bands 13 are less likely to wear down or to be damaged, unlike the bands 13 in the prior art shown in FIG. 5 in which the bands 13 are sandwiched between the wire holding plates 12 and the drumhead 2 and suffer friction from them.

In the above-described embodiment, the drum acoustic wire assembly 25 uses the coil-form acoustic wires 11. However, the present invention is by no means limited to this structure, and the drum acoustic wire assembly 25 can use, for instance, rectilinear acoustic wires.

In the above embodiment, the drum acoustic wire assembly and the drum of the present invention have a structure that prevents the base ends of the wire holding plates from sinking inward. Accordingly, the end portions of the acoustic wires do not float upward from the drumhead but can stay in tight contact with the drumhead. Thus, the area of the drumhead in contact with the acoustic wires can be increased, and a special playing effect with a large sound quantity can be obtained.

Furthermore, since it is only necessary to provide projecting portions on the undersurfaces of the base end portions of the wire holding plates, the structure of the acoustic wire assembly of the present invention is simple and can be manufactured easily.

What is claimed is:

1. A drum acoustic wire assembly installed on a drumhead, comprising: a plurality of acoustic wires disposed side by side in a direction that is perpendicular to a direction of axial line of each of said wires, and a pair of wire holding plates that hold end portions of said acoustic wires on the tip ends of the wire holding plates that are arranged inner than the base ends of the wire holding plates with respect to a periphery of the drumhead, so that said acoustic wires of said drum acoustic wire assembly is brought into contact with and separated from said drumhead; wherein a band is attached at each base end of the wire holding plate to secure the drum acoustic wire assembly to a drum body;

a projecting portion is provided at the base end of said wire holding plate on the surface facing the drumhead so that said base end is larger in thickness than said tip end; and each of said wire holding plates is formed so that a tip end thereof is equal to or lower than a base end thereof in height when said acoustic wires are in contact with said drumhead.

2. The drum acoustic wire according to claim 1, wherein said base end is provided on an undersurface of said wire holding plates with a projecting portion so that said base end is larger in thickness than said tip end.

3. A drum provided with said drum acoustic wire assembly according to claim 1.

4. A drum provided with said drum acoustic wire assembly according to claim 2.

* * * * *